US010608349B2

(12) United States Patent
Koshiishi

(10) Patent No.: US 10,608,349 B2
(45) Date of Patent: Mar. 31, 2020

(54) ELECTRIC WIRE WITH WIRE TERMINAL, WIRE TERMINAL AND WIRE TERMINAL CRIMPER

(71) Applicant: Yazaki Corporation, Tokyo (JP)

(72) Inventor: Makoto Koshiishi, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/249,377

(22) Filed: Jan. 16, 2019

(65) Prior Publication Data

US 2019/0221950 A1 Jul. 18, 2019

(30) Foreign Application Priority Data

Jan. 18, 2018 (JP) ..... 2018-006118

(51) Int. Cl.

| | |
|---|---|
| ***H01R 4/00*** | (2006.01) |
| ***H01R 4/18*** | (2006.01) |
| ***H01R 43/042*** | (2006.01) |
| ***H01R 43/058*** | (2006.01) |

(52) U.S. Cl.

CPC ..... *H01R 4/185* (2013.01); *H01R 43/042* (2013.01); *H01R 43/058* (2013.01)

(58) Field of Classification Search

CPC ..... H01R 4/18; H01R 4/183; H01R 43/058; H01R 43/055; H01R 13/5808; H01R 13/11; H01R 13/03; H01R 4/2495

USPC ..... 174/84 R, 84 C; 439/96, 790, 878, 877, 439/882, 888, 948

See application file for complete search history.

(56) References Cited

U.S. PATENT DOCUMENTS

| | | | | |
|---|---|---|---|---|
| 1,343,251 A * | 6/1920 | Dillon | H01R 4/188 | 403/278 |
| 2,747,171 A | 5/1956 | Martines | | |
| 3,892,459 A * | 7/1975 | Dittmann | H01R 4/188 | 439/442 |
| 3,990,143 A * | 11/1976 | Dittmann | H01R 4/188 | 29/865 |
| 4,142,771 A * | 3/1979 | Barnes | H01R 4/184 | 174/840 |
| 8,070,536 B2 * | 12/2011 | Ono | H01R 4/185 | 439/877 |

(Continued)

FOREIGN PATENT DOCUMENTS

| | | |
|---|---|---|
| JP | 45-20872 | 7/1970 |
| JP | 06-104020 A | 4/1994 |
| JP | 2010-244888 A | 10/2010 |

*Primary Examiner* — William H. Mayo, III

(74) *Attorney, Agent, or Firm* — Sughrue Mion, PLLC

(57) ABSTRACT

An electric wire is terminated with a wire terminal. The electric wire includes a conductor composed of strands and a sheath. The wire terminal includes a wire barrel portion that composed of a bottom plate, a first side plate extending from one side edge of the bottom plate and a second side plate extending from another side edge of the bottom plate. The wire barrel portion holds the conductor exposed from the sheath to make an electrical connection with the strands. The number of the strands contacting directly with the first side plate gradually changes along a longitudinal direction of the conductor. The number of the strands contacting directly with the second side plate gradually changes along the longitudinal direction inversely with respect to the first side plate.

6 Claims, 13 Drawing Sheets

(56) References Cited

U.S. PATENT DOCUMENTS

| | | | | |
|---|---|---|---|---|
| 8,177,590 | B2 * | 5/2012 | Tanaka | H01R 4/185<br>439/877 |
| 8,177,591 | B2 * | 5/2012 | Okamura | H01R 4/188<br>439/877 |
| 9,343,820 | B2 * | 5/2016 | DeSantis | H01R 4/18 |
| 9,768,524 | B2 * | 9/2017 | Seipel | H01R 4/182 |
| 2002/0022414 | A1 * | 2/2002 | Kitagawa | H01R 4/184<br>439/877 |
| 2006/0057904 | A1 * | 3/2006 | Sakaguchi | H01R 4/185<br>439/877 |

* cited by examiner

ELECTRIC WIRE WITH WIRE TERMINAL, WIRE TERMINAL AND WIRE TERMINAL CRIMPER

CROSS REFERENCE TO RELATED APPLICATION

This application is based upon and claims the benefit of priority from the prior Japanese Patent Application No. 2018-6118 (filing date: Jan. 18, 2018), the entire contents of which are incorporated herein by reference.

BACKGROUND OF THE INVENTION

Technical Field

The present invention relates to an electric wire with a wire terminal, a wire terminal and a wire terminal crimper.

Background Arts

A terminated wire 301 as shown in FIG. 14 and FIG. 15 is made by terminating an end of an electric wire 3 with a wire terminal 305. A Japanese Patent Application Laid-open No. H06-104020 discloses such a terminated wire (i.e. an electric wire and a wire terminal). The terminated wire 301 is assembled as explained below. First, the electric wire 3 as shown in FIG. 13A is prepared, and then its sheath 11 is stripped at an end of the electric wire 3. As a result, a conductor 9 composed of plural strands 7 is exposed by a given length as shown in FIG. 13B. Subsequently, a pair of tabs (a wire barrel portion) 313 of a wire terminal 305 is crimped (swaged), and thereby the exposed conductor 9A is held tightly by the wire barrel portion 313 as shown in FIG. 14 and FIG. 15.

SUMMARY OF THE INVENTION

On a cross-sectional plane of the wire barrel portion 313 that holds the conductor 9 in the terminated wire 301 as shown in FIG. 16, some of the strands 7A in the strands 7 contact directly with the wire barrel portion 313 (the wire terminal 305). In the terminated wire 301, the strands 7A contacting directly with the wire barrel portion 313 hardly change on any cross-sectional plane along a longitudinal direction of the electric wire 3 (the strands 7A, the conductor 9). FIG. 16 shows a view on the cross sectional plane taken at a middle of the wire barrel portion 313 that holds the conductor 9 (taken long a line XVI-XVI shown in FIG. 15), but any cross-sectional plane along a horizontal direction in FIG. 15 presents almost the same cross-sectional view as the cross-sectional view shown in FIG. 16.

Remaining other strands 7B don't contact directly with the wire barrel portion 313. An electrical resistance between the other strands 7B and the wire barrel portion 313 becomes larger than that between the strands 7A and the wire barrel portion 313, because the other strands 7B contact indirectly with the wire barrel portion 313 with the strands 7A interposed therebetween. Therefore, according to the above-mentioned conventional terminated wire 301, the electrical resistance between the wire terminal 305 and the conductor 9 may become large, because the strands 7A contacting directly with the wire barrel portion 313 don't change as explained above. The more the number of the strands 7 in the electric wire 3 increases, the more pronounced this problem may become.

An object of the present invention is to provide an electric wire terminated with a wire terminal (i.e. a terminated wire) whose exposed conductor is electrically connected with a wire barrel portion of the wire terminal and that can prevent its electrical resistance between the conductor and the wire terminal from being large, and to provide a wire terminal used for the above terminated wire, and to provide a wire terminal crimper used for making the above terminated wire.

A first aspect of the present invention provides an electric wire terminated with a wire terminal, comprising: the electric wire including a conductor comprising a plurality of strands and a sheath covering the conductor, a given length of the conductor being exposed from the sheath; and the wire terminal including a wire barrel portion comprising a bottom plate, a first side plate extending from one side edge of the bottom plate and a second side plate extending from another side edge of the bottom plate, the one side and the other side of the bottom plate being opposite to each other, wherein the wire barrel portion holds the conductor exposed from the sheath to make an electrical connection with the strands, the number of the strands contacting directly with the first side plate gradually changes along a longitudinal direction of the conductor exposed from the sheath, and the number of the strands contacting directly with the second side plate gradually changes along the longitudinal direction of the conductor exposed from the sheath inversely with respect to the first side plate.

A second aspect of the present invention provides a wire terminal comprising: a wire barrel portion including a bottom plate, a first side plate extending from one side edge of the bottom plate, and a second side plate extending from another side edge of the bottom plate, the one side and the other side of the bottom plate being opposite to each other, wherein, in a state where the wire terminal were expanded flat, a side edge of the first side plate extends obliquely with respect to the longitudinal direction, and a side edge of the second side plate extends obliquely with respect to the longitudinal direction to be parallel to the side edge of the first side plate.

A third aspect of the present invention provides a wire terminal crimper to be used with an anvil when crimping a wire barrel portion of a wire terminal such that the wire barrel portion holds an conductor of an electric wire, the wire terminal including a wire barrel portion comprising a bottom plate and a first side plates extending from one side edge of the bottom plate and a second side plates extending from another side edge of the bottom plate and the conductor being exposed by a given length, the crimper comprising: a crimper body; and a notch formed in the crimper body and to which the wire barrel portion and a plurality of strands of the conductor are to be entered when crimping the wire barrel portion, wherein a first curved portion to be contacted with the first side plate of the wire terminal to crimp the first side plate and a second curved portion to be contacted with the second side plate of the wire terminal to crimp the second side plate are formed on the bottom of the notch, the first curved portion and the second curved portion are adjacent to each other, and a border ridge between the first curved portion and the second curved portion extends obliquely with respect to a longitudinal direction of the conductor when crimping the wire terminal.

DESCRIPTION OF THE EMBODIMENTS

First Embodiment

Figure 1:
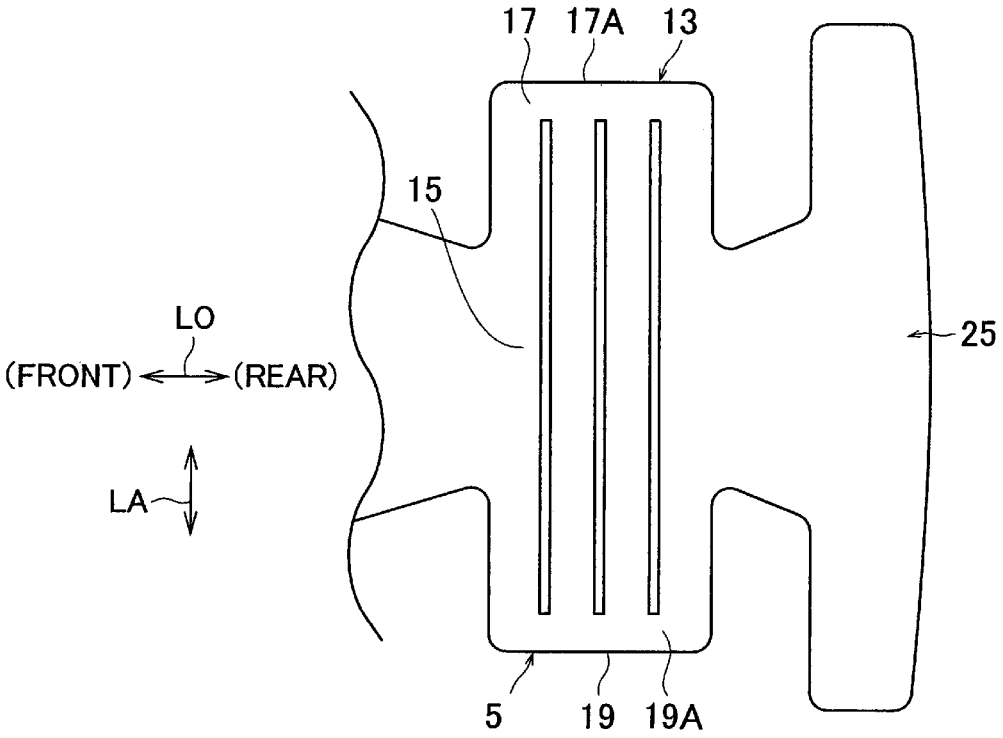
FIG. 1 is a development view of a wire terminal to be used in a terminated wire according to a first embodiment.

A terminated wire 1 (i.e. an electric wire 3 terminated with a wire terminal 5) according to a first embodiment includes the electric wire 3 and the wire terminal 5 as shown in FIG. 1 to FIG. 6. Hereinafter, as a matter of convenience for description, a longitudinal direction of the electric wire 3 (the terminated wire 1) is denoted as a longitudinal direction LO. One direction perpendicular to the longitudinal direction LO is denoted as a vertical direction VE. A direction perpendicular to both of the longitudinal direction LO and the vertical direction VE is denoted as a lateral direction LA. In the terminated wire 1, the lateral direction LA is a direction extending from one of base ends of side plates 17 and 19 toward the other thereof. Note that the one of the base ends is a border between the first side plate 17 and a bottom plate 15, and the other of the base ends is a border between the second side plate 19 and the bottom plate 15.

The electric wire 3 includes a conductor 9 composed of plural strands 7 and a sheath 11 covering the conductor 9. The conductor 9 is exposed from the sheath 11 by a given length at its end. The wire terminal 5 is made of an electrically conductive material such as metal, and includes a wire barrel portion 13. The wire barrel portion 13 includes the bottom plate 15, the first side plate 17 extended (protruded) from one lateral side of the bottom plate 15, and the second side plate 19 extended (protruded) from the other lateral side of the bottom plate 15. When the wire barrel portion 13 is swaged (turned into a swaged state), the wire barrel portion 13 wraps and holds the conductor 9 by the given length and thereby the wire barrel portion 13 is electrically contacted with the exposed conductor 9A of the electric wire 3.

In the terminated wire 1, the number of the strands 7 contacting directly with the first side plate 17 gradually changes along the longitudinal direction LO (the longitudinal direction of the electric wire 3 or the conductor 9). In addition, the number of the strands 7 contacting directly with the second side plate 19 also gradually changes along the longitudinal direction LO inversely with respect to the first side plate 17.

Specifically as shown in FIG. 5 and FIGS. 6A to 6C, the number of the strands 7 contacting directly with the first side plate 17 gradually decreases from front to rear along the longitudinal direction LO. On the other hand, the number of the strands 7 contacting directly with the second side plate 19 gradually increases from front to rear along the longitudinal direction LO. In each of FIGS. 6A to 6C, the strands 7 contact directly with the wire barrel portion 13 (=the bottom plate 15+the side plates 17 and 19) are indicated by hatchings.

In addition, at any position along the longitudinal direction LO, a sum of the number of the strands 7 contacting directly with the first side plate 17 and the number of the strands 7 contacting directly with the second side plate 19 is almost constant.

Namely, [1] a sum of the number of the strands 7 contacting directly with the first side plate 17 and the number of the strands 7 contacting directly with the second side plate 19 at a front end of the wire barrel portion 13 (see FIG. 6A), [2] a sum of the number of the strands 7 contacting directly with the first side plate 17 and the number of the strands 7 contacting directly with the second side plate 19 at a middle of the wire barrel portion 13 along the longitudinal direction LO (see FIG. 6B), and [3] a sum of the number of the strands 7 contacting directly with the first side plate 17 and the number of the strands 7 contacting directly with the second side plate 19 at a rear end of the wire barrel portion 13 (see FIG. 6C) take an almost identical value to each other.

Note that, at any position along the longitudinal direction LO, the number of the strands 7 contacting directly with the bottom plate 15 is almost constant. FIG. 6D shows all the strands 7 contacting directly with the wire terminal 5 (the wire barrel portion 13=the bottom plate 15+the side plates 17 and 19) by hatchings (i.e. superimposition of FIGS. 6A to 6C).

Figure 6A:
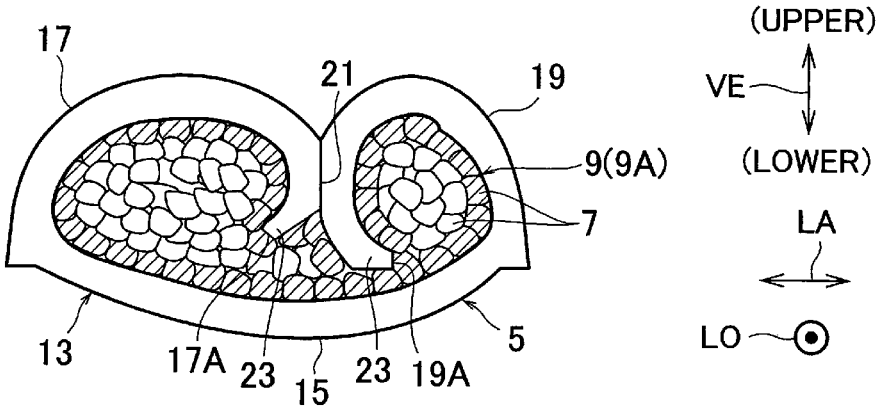
FIG. 6A is a cross-sectional view taken along a line VIA-VIA shown in FIG. 5.
Figure 6B:
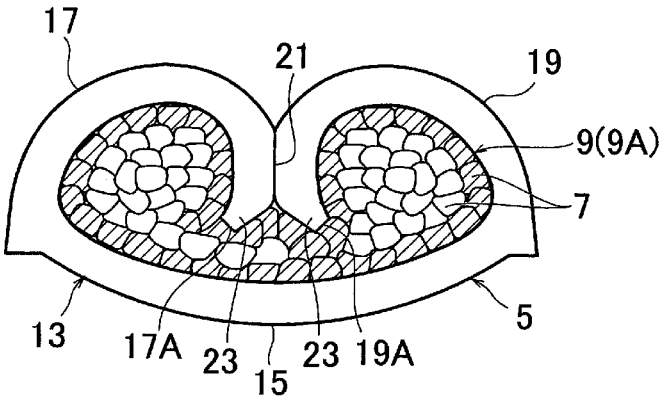
FIG. 6B is a cross-sectional view taken along a line VIB-VIB shown in FIG. 5.
Figure 6C:
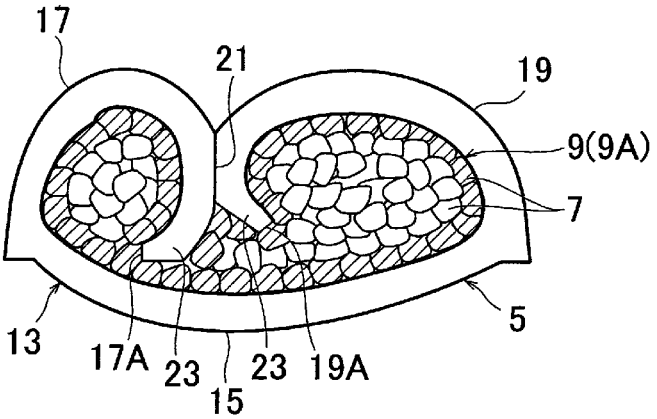
FIG. 6C is a cross-sectional view taken along a line VIC-VIC shown in FIG. 5.
Figure 6D:
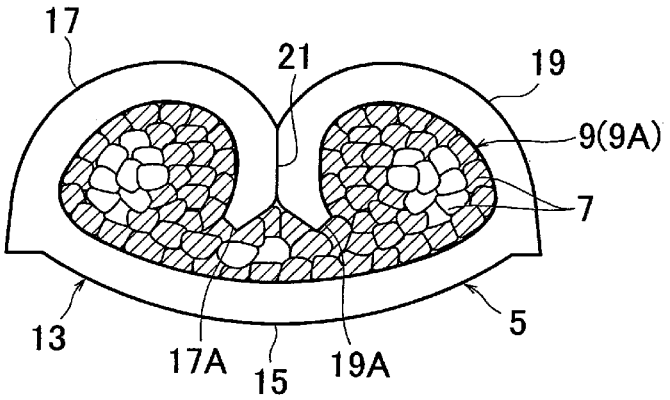
FIG. 6D is a cross-sectional view showing all strands contacting directly with a wire barrel portion by hatching.
Figure 7:
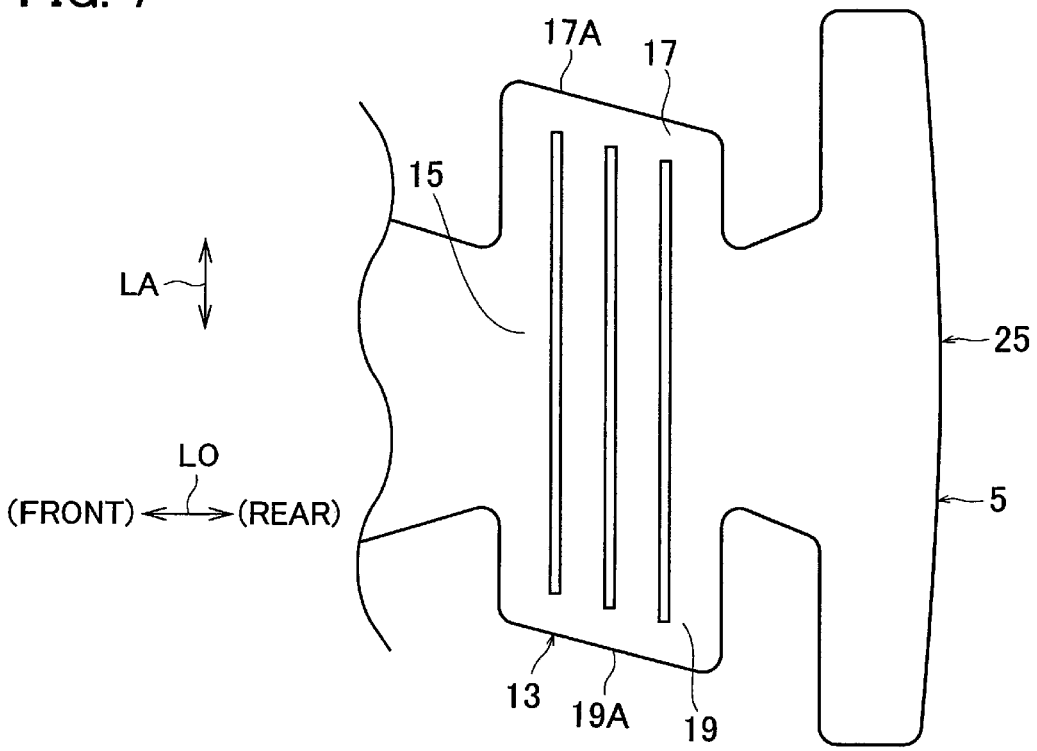
FIG. 7 is a development view of a wire terminal to be used in a terminated wire according to a second embodiment.

On the cross-sectional views (i.e. on the cross-sectional planes perpendicular to the longitudinal direction LO) of the wire barrel portion 13 as shown in FIGS. 6A to 6C, each of the side plates 17 and 19 forms a major arc (an arc larger than a semicircle) to surround the strands 7 (the conductor 9) together with the bottom plate 15. In addition, a chord length of the arc of the first side plate 17 in the lateral direction LA gradually decreases from front to rear (from FIG. 6A to FIG. 6C). On the other hand, a chord length of the arc of the second side plate 19 in the lateral direction LA gradually increases from front to rear (from FIG. 6A to FIG. 6C). Note that the above mentioned is also denoted as a distance in the lateral direction within an inner surface of the side plate 17 or 19. In addition, a sum of the chord length of the arc of the first side plate 17 and the chord length of the arc of the second side plate 19 hardly changes. Namely, the sum is almost constant at any position along the longitudinal direction LO.

Further, a distance between the base end of the first side plate 17 (the border between the first side plate 17 and the bottom plate 15) and an uppermost point of the inner surface of the first side plate 17 along the vertical direction VE hardly changes, and thereby the distance is almost constant at any position along the longitudinal direction LO. Similarly, a distance between the base end of the second side plate 19 (the border between the second side plate 19 and the bottom plate 15) and an uppermost point of the inner surface of the second side plate 19 along the vertical direction VE hardly changes, and thereby the distance is almost constant at any position along the longitudinal direction LO. Note that the base end of the first side plate 17 and the base end of the second side plate 19 are located at an almost identical position to each other along the vertical direction VE.

The side plates 17 and 19 contact with each other at an intermediate position in each extending direction thereof (protruded direction from the bottom plate 15, curved direction along each curvature thereof), and thereby a side-plate contacting portion 21 is formed. A curvature radius of the arc of the first side plate 17 between the base end of the first side plate 17 and the side-plate contacting portion 21 gradually decreases from front to rear. A curvature radius of the arc of the second side plate 19 between the base end of the second side plate 19 and the side-plate contacting portion 21 gradually increases from front to rear.

Hereinafter, the electric wire 3 will be described more in detail. As described above, the electric wire 3 includes the conductor (wire core) 9 composed of the plural strands 7 and the sheath (insulator) 11 covering the conductor 9. The sheath 11 doesn't exist at a portion (e.g. a front end) of the electric wire 3 in the longitudinal direction LO (by stripping the sheath 11), and thereby the conductor 9 is exposed by the given length (the exposed conductor 9A is formed). The strands 7 of the conductor 9 are made of metal such as copper, aluminum, aluminum alloy or the like, and the strands 7 forms a long straight cylindrical shape as a whole. The conductor 9 is configured by twisting the strands 7 or by bundling the straight strands 7.

A cross-sectional shape (on a cross-sectional plane perpendicular to the longitudinal direction LO) of another portion of the electric wire 3 having the sheath 11 presents a given shape, e.g. an almost circular shape, formed by bundling the strands 7 tightly with (almost) no space among them. A cross-sectional shape of the sheath 11 on the cross-sectional plane (at the other portion of the electric wire 3 having the sheath 11) presents a ring shape having a given thickness. An entire outer circumference of the conductor 9 contacts with an entire inner circumference of the sheath 11.

Next, the wire terminal 5 will be described more in detail. In a state where the wire terminal 5 (the wire barrel portion 13) is expanded flat (were made flat) [a state where the wire barrel portion 13 is opened to release the conductor 9 and then made flat] (see FIG. 1) or in a state just before the wire barrel portion 13 is crimped (the wire barrel portion 13 has a "U" shape: see FIG. 2), a side edge 17A of the first side plate 17 (opposite to the bottom plate 15) and a side edge 19A of the second side plate 19 (opposite to the bottom plate 15) extend parallel to each other in the longitudinal direction LO.

Figure 5:
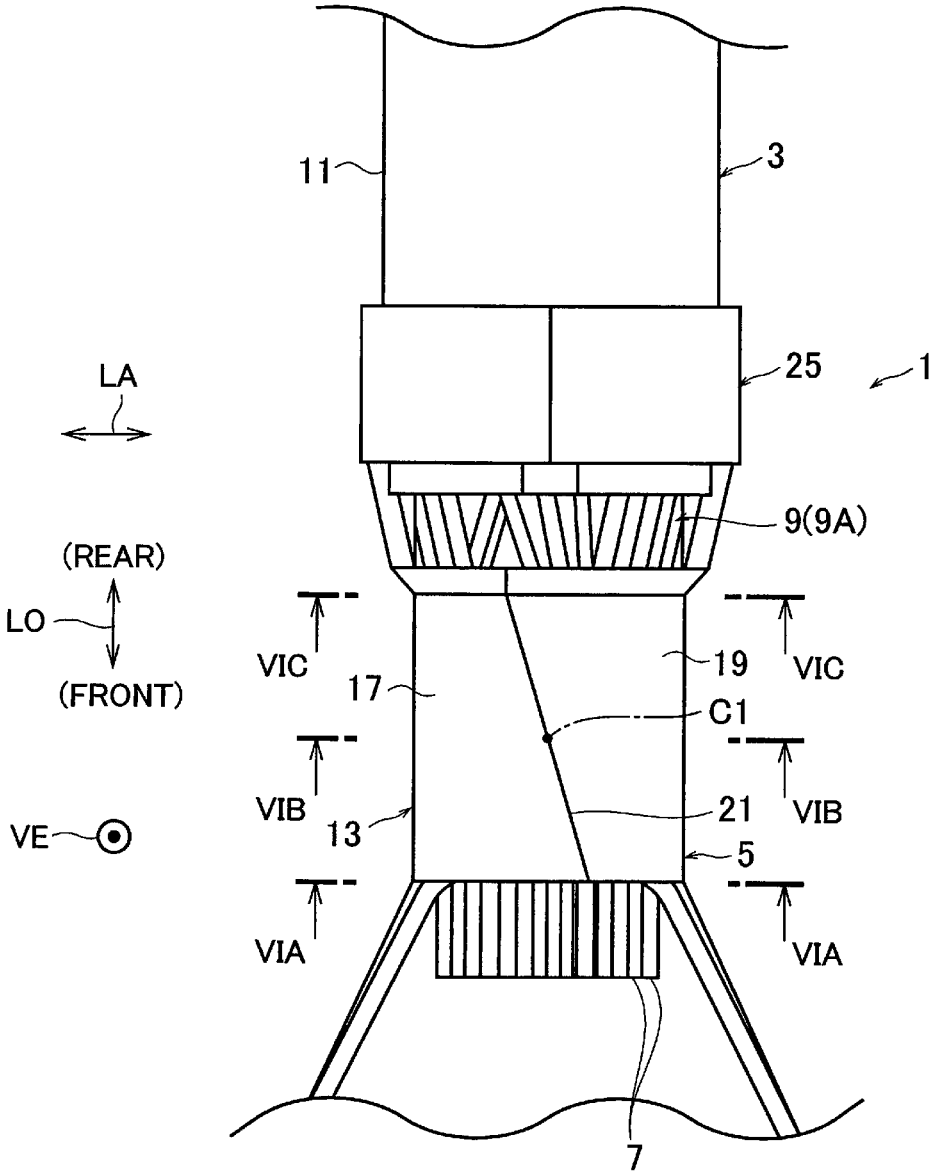
FIG. 5 is a partial plan view of the terminated wire.

When viewing along the vertical direction VE as shown in FIG. 5, the side-plate contacting portion 21 inclines such that its front end is closer to one side in the lateral direction LA and its rear end is closer to the other side in the lateral direction LA. Namely, when viewing along the vertical direction VE, the side-plate contacting portion 21 inclines with respect to the longitudinal direction LO. At the middle along the longitudinal direction LO, the cross-sectional shape of the wire barrel portion 13 (see FIG. 6B) is laterally symmetric.

On the cross-sectional views along the longitudinal direction LO (see FIGS. 6A to 6C), each of the side plates 17 and 19 in the terminated wire 1 is curled (to have a "C" shape), and each end portion 23 of the side plates 17 and 19 pushes aside the strands 7 to enter into the conductor 9. The end portion 23 of the first side plates 17 is a portion between the side-plate contacting portion 21 and the side edge 17A, and the end portion 23 of the second side plates 19 is a portion between the side-plate contacting portion 21 and the side edge 19A. When viewing along the vertical direction VE, the first side plate 17 and the second side plate 19 are point-symmetric with respect to a center axis C1 (see FIG. 5) passing thorough the center of the wire barrel portion 13 and extending in the vertical direction VE.

Figure 2:
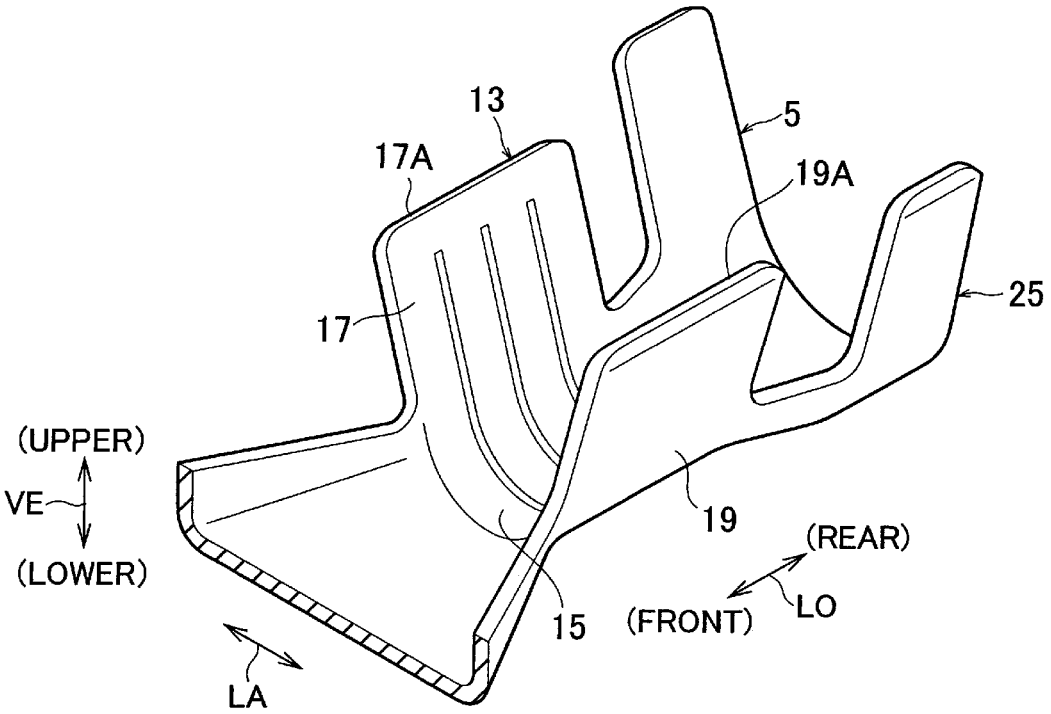
FIG. 2 is a partially cross-sectioned perspective view of the wire terminal (not yet crimped)

In addition, an insulation barrel portion 25 is provided in the wire terminal 5 as shown in FIG. 2 and FIG. 5. The insulation barrel portion 25 is crimped (swaged), and thereby the end portion of the sheath 11 of the electric wire 3 is held by the wire terminal 5.

Next, a crimper 27 used for crimping the wire barrel portion 13 of the wire terminal 5 will be described with reference to FIG. 3 and FIGS. 4A to 4D. The wire barrel portion 13 that is not yet crimped (see FIG. 2) is formed to have a "U" shape. Crimping of the wire barrel portion 13 is done by pressing the wire barrel portion 13 and the conductor 9 (the strands 7) located within the wire barrel portion 13 by use of the crimper 27 and an anvil (not shown in the drawings). The crimper 27 and the anvil can be installed in a production machine of the terminated wire(s) 1. Note that the crimper 27 and the anvil may be provided as a wire terminal crimper (crimping plier, ratchet crimping tool) that is to be used when a user manually crimps the wire terminal 5.

Figure 3:
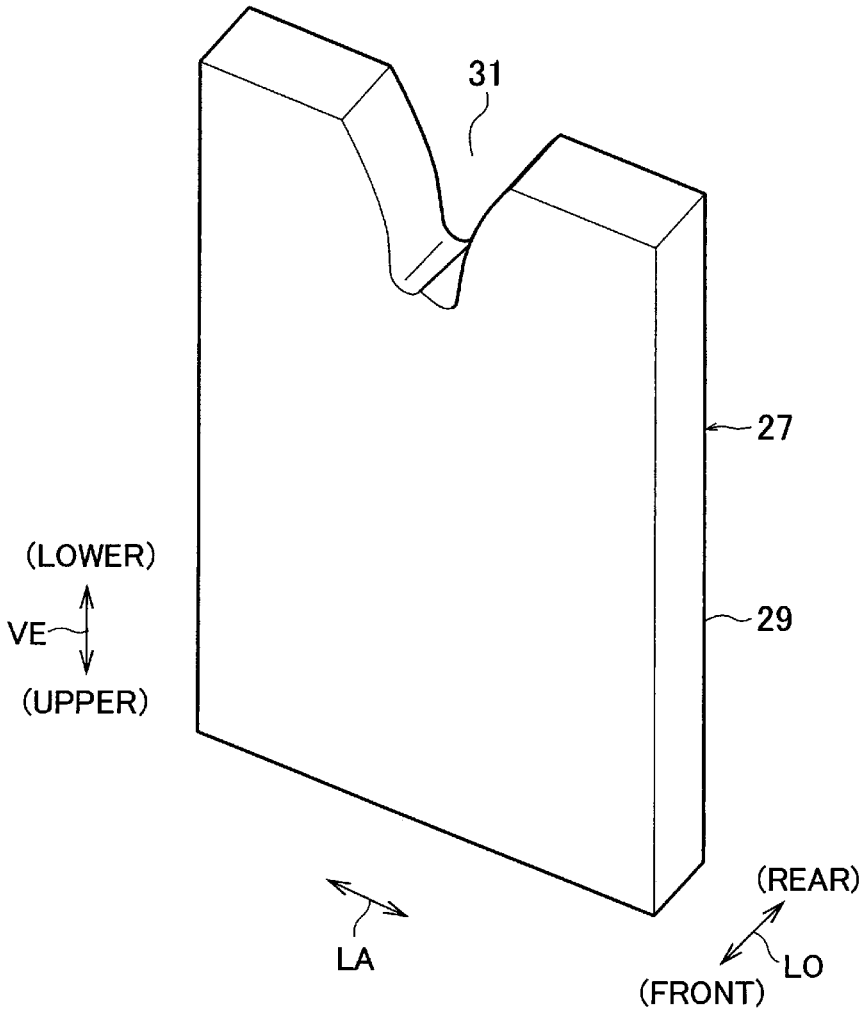
FIG. 3 is a perspective view of a terminal crimper used for crimping the wire terminal.
Figure 4A:
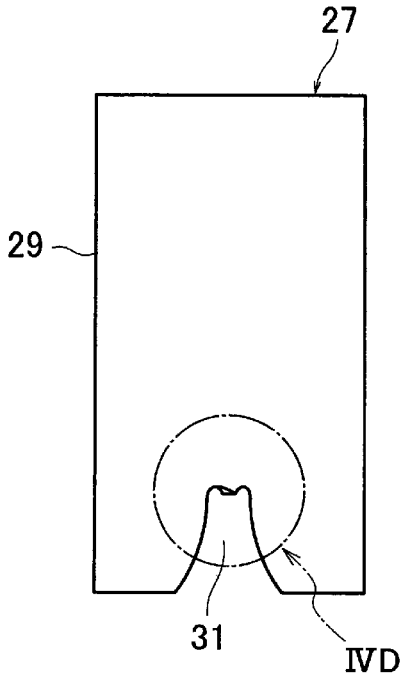
FIG. 4A is a front view of the terminal crimper.
Figure 4B:
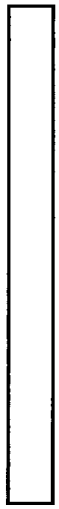
FIG. 4B is a side view of the terminal crimper.
Figure 4C:
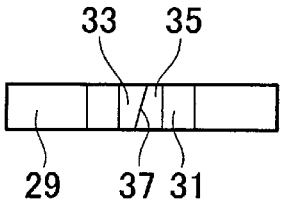
FIG. 4C is a bottom view of the terminal crimper.
Figure 4D:
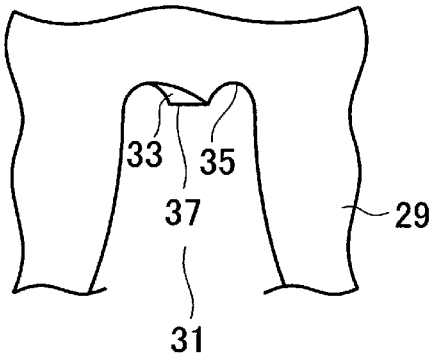
FIG. 4D is an enlarged front view of a portion IVD shown in FIG. 4A.

The crimper 27 includes a crimper body 29 formed to have a rectangular flat-planar shape. A notch 31 is formed on the crimper body 29. When crimping the wire barrel portion 13, the wire barrel portion 13 in which the conductor 9 is being set and the anvil enter into the notch 31 sequentially in this order. A first curved surface (first curved portion) 33 and a second curved surface (second curved portion) 35 are formed on the bottom of the notch 31 as shown in FIG. 3 [the curved surfaces 33 and 35 are formed at an uppermost portion in the notch 31 in the vertical direction VE (see FIGS. 4A and 4D)].

The first curved surface 33 contacts with the first side plate 17, and then curls the first side plate 17 together with the anvil to hold the conductor 9 tightly between the first side plate 17 and part of the bottom plate 15, i.e. swages the first side plate 17. Similarly, the second curved surface 35 contacts with the second side plate 19, and then curls the second side plate 19 together with the anvil to hold the conductor 9 tightly between the second side plate 19 and remaining part of the bottom plate 15, i.e. swages the second side plate 19.

The first curved surface 33 and the second curved surface 35 are adjacent to each other. A border ridge 37 between the first curved surface 33 and the second curved surface 35 inclines with respect to the longitudinal direction LO (the longitudinal direction of the electric wire 3 when crimping the wire barrel portion 13).

The crimper body 29 has a rectangular flat-planar shape as already explained above, and has a given thickness in the longitudinal direction LO, a given width in the lateral direction LA and a given height in the vertical direction VE. The notch 31 is formed at the center of the crimper body 29 in the lateral direction LA. The notch 31 is formed as though the crimper body 29 is carved upward from its lower end in the vertical direction VE. The notch 31 passes through the crimper body 29 in the longitudinal direction LO.

The notch 31 is formed longwise such that its height in the vertical direction VE is made larger than its width in the lateral direction LA. The first curved surface 33 is formed on one side in the lateral direction LA on the bottom of the notch 31 [at the uppermost portion in the notch 31 in the vertical direction VE]. The second curved surface 35 is formed on the other side in the lateral direction LA on the bottom of the notch 31 [at the uppermost portion in the notch 31 in the vertical direction VE].

The first curved surface 33 is formed concave downward when being viewed along the longitudinal direction LO. The second curved surface 35 is also formed concave downward when being viewed along the longitudinal direction LO. The lateral center of the first curved surface 33 is located at an uppermost position in the vertical direction VE, and the lateral center of the second curved surface 35 is also located at the uppermost position in the vertical direction VE. The border ridge 37 between the first curved surface 33 and the second curved surface 35 is formed straight, and located at a lower position than the uppermost position (the lateral centers of the curved surfaces 33 and 35).

A curvature radius of the first curved surface 33 decreases from front to rear. On the other hand, a curvature radius of the second curved surface 35 increases from front to rear. The notch 31 (the curved surfaces 33 and 35 and the border ridge 37) is rotationally-symmetric (2-fold, 180°) with respect to a center axis passing thorough the center of the border ridge 37 (the center of the notch 31/the crimper body 29) and extending in the vertical direction VE. The straight border ridge 37 is perpendicular to the vertical direction VE, and the straight border ridge 37 and the above-mentioned center axis intersect one another.

Figure 13A:
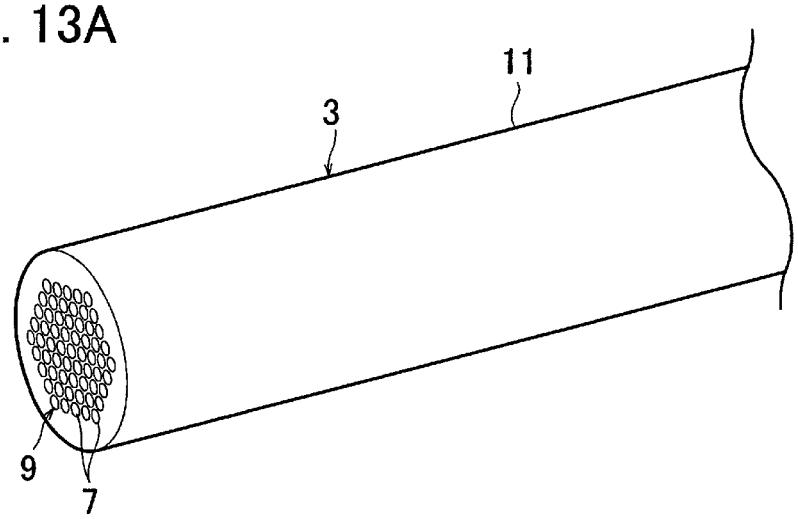
FIG. 13A is a perspective view of an end of an electric wire.
Figure 13B:
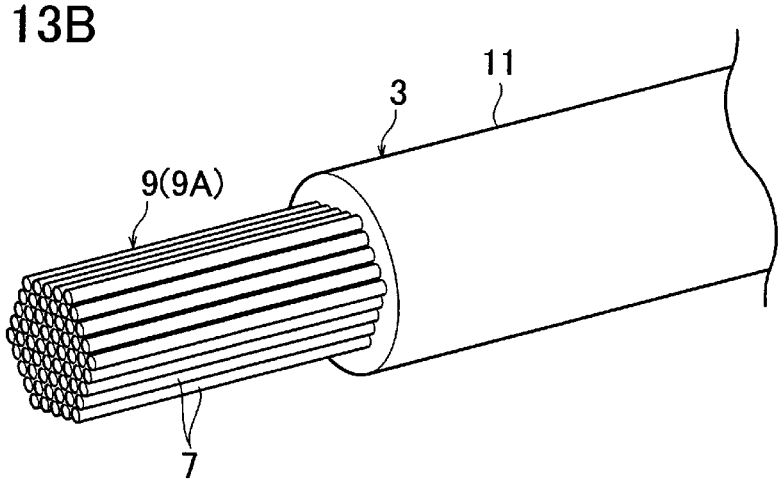
FIG. 13B is a perspective view of the electric wire whose sheath is stripped at its an end.
Figure 14:
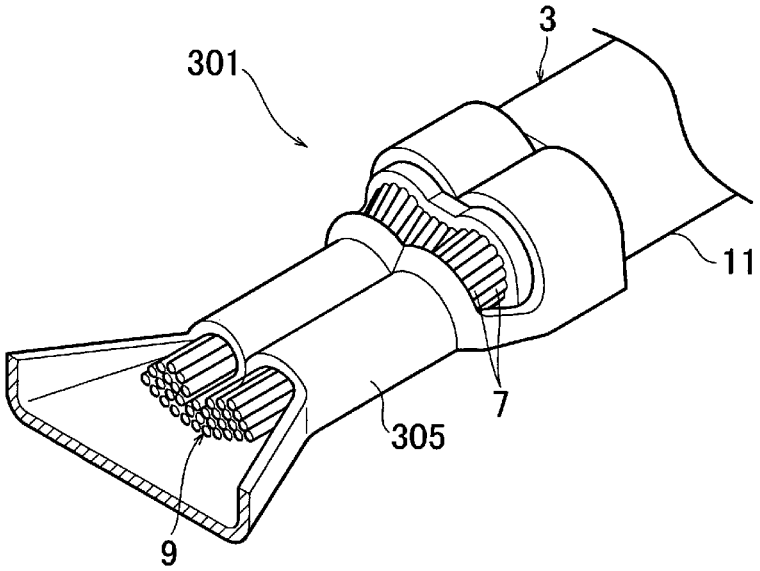
FIG. 14 RELATED ART
FIG. 14 is a partially cross-sectioned perspective view of an electric wire terminated with a conventional wire terminal.
Figure 15:
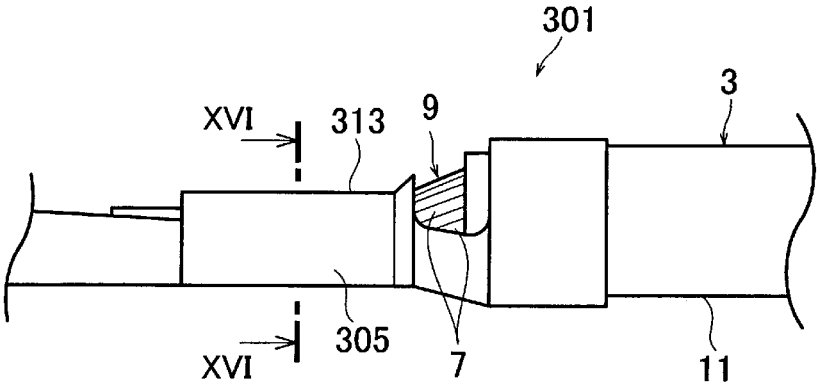
FIG. 15 RELATED ART
FIG. 15 is a side view of the terminated wire.

Next, a producing method of the terminated wire 1 will be described. The electric wire 3 at whose one end the conductor 9 is exposed as shown in FIG. 13B and the wire terminal 5 not yet crimped as shown in FIG. 2 are prepared. The exposed conductor 9A is set inside the wire barrel portion 13 having a "U" shape. Subsequently, the wire barrel portion 13 is crimped (swaged) by the crimper 27 and the anvil. Note that the insulation barrel portion 25 is also crimped by another crimper and another anvil (or the same anvil). The terminated wire 1 is made in this manner, so that one side of its wire barrel portion 13 in the lateral direction LA is different from the other side thereof in their shapes (i.e. not laterally symmetrical in the lateral direction LA).

Figure 16:
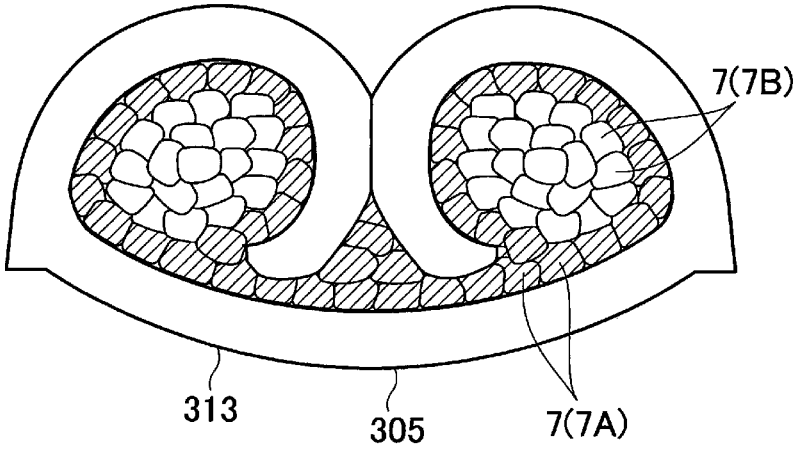
FIG. 16 RELATED ART
FIG. 16 is a cross-sectional view taken along a line XVI-XVI shown in FIG. 15.

According to the terminated wire 1, the number of the strands 7 contacting directly with the first side plate 17 or the second side plate 19 gradually changes along the longitudinal direction LO. Therefore, as shown in FIG. 6D, the strands 7 contacting directly with the wire barrel portion 13 becomes more than that in a conventional terminated wire (see the terminated wire 301 shown in FIG. 16). As the result, an electrical resistance between the conductor 9 and the wire terminal 5 can be prevented from being large (can be reduced).

In addition, according to the terminated wire 1, the number of the strands 7 contacting directly with the first side plate 17 gradually changes along the longitudinal direction LO, and the number of the strands 7 contacting directly with the second side plate 19 gradually changes along the longitudinal direction LO inversely with respect to the first side plate 17. Namely the number of the strands 7 contacting directly with the first side plate 17 decreases along the longitudinal direction LO with increasing of the number of the strands 7 contacting directly with the second side plate 19. Therefore, the strands 7 (the conductor 9) can be held by the side plates 17 and 19 in a well-balanced manner.

Further, according to the terminated wire 1, the distance of the inner surface of the first side plate 17 in the lateral direction LA gradually decreases from front to rear, and the distance of the inner surface of the second side plate 19 in the lateral direction LA gradually increases from front to rear (from FIG. 6A to FIG. 6C). Therefore, the strands 7 (the conductor 9) can be held by the side plates 17 and 19 in a well-balanced manner without changing a lateral size and a vertical size of the wire barrel portion 13 along the longitudinal direction LO (i.e. while keeping the lateral size and the vertical size of the wire barrel portion 13 constant along the longitudinal direction LO).

Furthermore, according to the terminated wire 1, the side edge 17A of the first side plate 17 and the side edge 19A of the second side plate 19 extend in the longitudinal direction LO. Therefore, an electrical resistance between the electric wire 3 and the wire terminal 5 can be prevented from increasing even when using a versatile wire terminal that has been used conventionally.

Second Embodiment

As shown in FIG. 7 to FIG. 12, a terminated wire 1*a* according to a second embodiment is different from the terminated wire 1 according to the above-described first embodiment only in a shape of the wire barrel portion 13 and a shape of the crimper 27. Except for those different shapes of the wire barrel portion 13 and the crimper 27, the terminated wire 1*a* according to the second embodiment has almost the same configuration as that of the terminated wire 1 according to the above-described first embodiment.

Figure 12A:
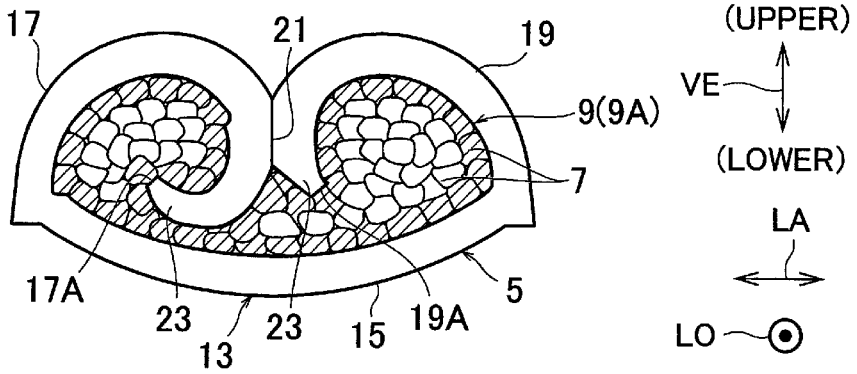
FIG. 12A is a cross-sectional view taken along a line XIIA-XIIA shown in FIG. 11.
Figure 12B:
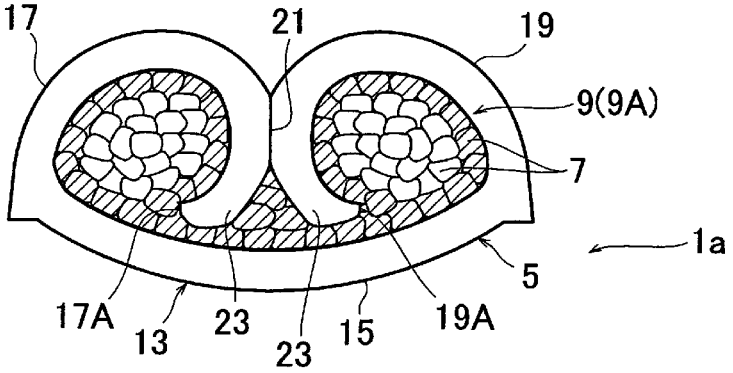
FIG. 12B is a cross-sectional view taken along a line XIIB-XIIB shown in FIG. 11.
Figure 12C:
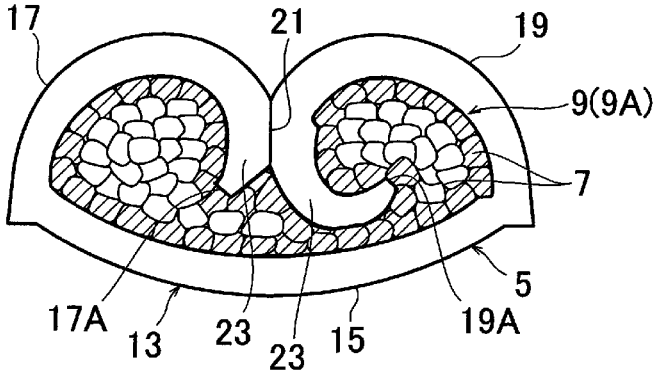
FIG. 12C is a cross-sectional view taken along a line XIIC-XIIC shown in FIG. 11.

On the cross-sectional views (i.e. on the cross-sectional planes perpendicular to the longitudinal direction LO) of the wire barrel portion 13 of the terminated wire 1*a* as shown in FIGS. 12A to 12C, each of the side plates 17 and 19 forms a major arc (an arc larger than a semicircle) to surround the strands 7 (the conductor 9) together with the bottom plate 15. The side plates 17 and 19 contact with each other at an intermediate position in each extending direction thereof (protruded direction from the bottom plate 15, curved direction along each curvature thereof), and thereby the side-plate contacting portion 21 is formed.

On the cross-sectional views along the longitudinal direction LO (see FIGS. 12A to 12C), an extending length of the first side plate 17 from the side-plate contacting portion 21 gradually decreases from front to rear. On the other hand, an extending length of the second side plate 19 from the side-plate contacting portion 21 gradually increases from front to rear. In addition, a sum of the extending length of the first side plate 17 from the side-plate contacting portion 21 and the extending length of the second side plate 19 from the side-plate contacting portion 21 hardly changes. Namely, the sum is almost constant at any position along the longitudinal direction LO.

On the other hand, a curvature radius of an arc between the base end of the first side plate 17 and the side-plate contacting portion 21 (a curvature radius of an arc of the first side plate 17) and a curvature radius of an arc between the base end of the second side plate 19 and the side-plate contacting portion 21 (a curvature radius of an arc of the second side plate 19) are equivalent to each other. In addition, each of these two curvatures is almost constant at any position along the longitudinal direction LO.

In a state where the wire terminal 5 (the wire barrel portion 13) is expanded flat (were made flat) [a state where the wire barrel portion 13 is opened to release the conductor 9 and then made flat] (see FIG. 7), the side edge 17A of the first side plate 17 (opposite to the bottom plate 15) and the side edge 19A of the second side plate 19 (opposite to the bottom plate 15) extend parallel to each other but obliquely with respect to the longitudinal direction LO. In a state just before the wire barrel portion 13 is crimped (the wire barrel portion 13 has a "U" shape: see FIG. 8), the side edge 17A and the side edge 19A are inclined with respect to the longitudinal direction LO, but they are inversely oblique with respect to each other. Namely, the side edge 17A and the side edge 19A are skew in a three-dimensional space.

In other words, when viewing the wire terminal 5 of which the wire barrel portion 13 is not yet crimped (see FIG. 8) along the lateral direction LA, the first side plate 17 extends obliquely with respect to the longitudinal direction LO. The second side plate 19 extends obliquely with respect to the longitudinal direction LO, but the second side plate 19 inclines inversely with respect to the first side plate 17. Namely, by explaining this view along the longitudinal direction LO by using a clock position, the longitudinal direction LO is denoted as a direction passing through 3 o'clock and 9 o'clock, and the side edge 17A extends in a direction passing through 4 o'clock and 10 o'clock and the side edge 19A extends in a direction passing through 2 o'clock and 8 o'clock.

When viewing the wire barrel portion 13 expanded flat along the vertical direction VE (see FIG. 7), the wire barrel portion 13 has a parallelogram shape. One of two pairs of opposite sides is the side edge 17A and the side edge 19A. When viewing the wire barrel portion 13 (after being crimped) in the terminated wire 1*a* along the vertical direction VE (see FIG. 11), the side-plate contacting portion 21 passes through the center of the wire barrel portion 13 and extends in the longitudinal direction LO.

On the cross-sectional views along the longitudinal direction LO (see FIGS. 12A to 12C), each of the side plates 17 and 19 in the terminated wire 1*a* is curled (to have a "C" shape), and each end portion 23 of the side plates 17 and 19 pushes aside the strands 7 to enter into the conductor 9. The end portion 23 of the first side plates 17 is a portion between the side-plate contacting portion 21 and the side edge 17A, and the end portion 23 of the second side plates 19 is a portion between the side-plate contacting portion 21 and the side edge 19A.

Figure 8:
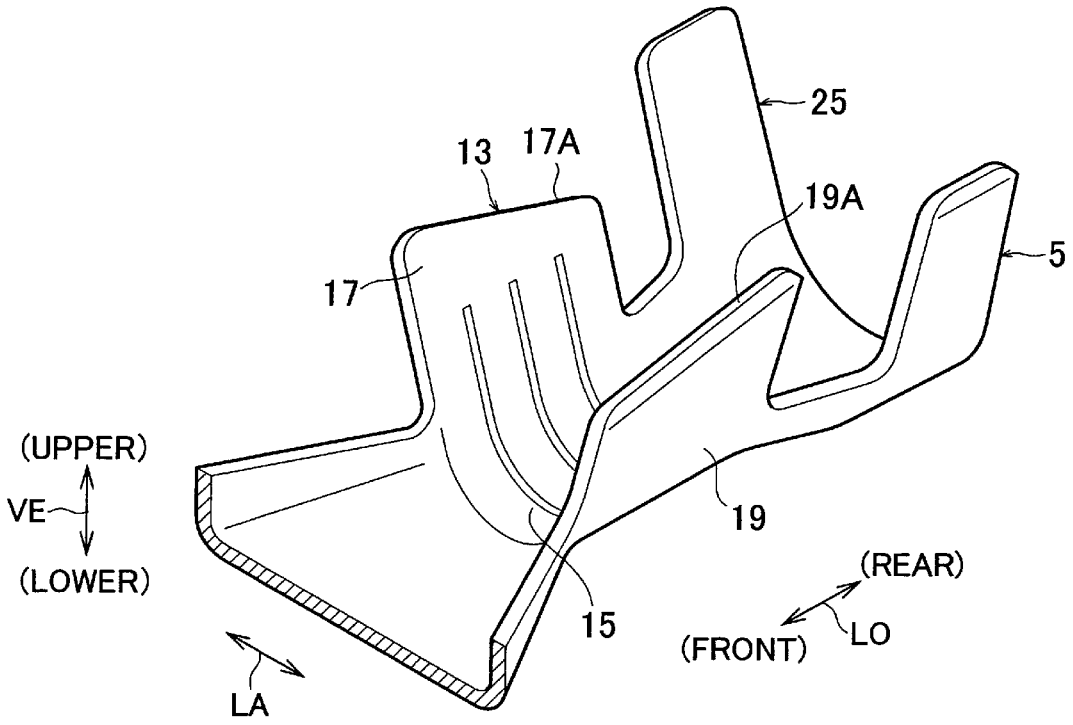
FIG. 8 is a partially cross-sectioned perspective view of the wire terminal (not yet crimped)

Next, a crimper 27*a* used for crimping the wire barrel portion 13 of the wire terminal 5 will be described with reference to FIG. 9 and FIGS. 10A to 10C. The crimper 27*a* in the present embodiment is different from the crimper 27 in the first embodiment in that the border ridge 37 of the crimper 27*a* extends in the longitudinal direction LO (don't incline with respect to the longitudinal direction LO). As shown in FIG. 8, the wire barrel portion 13 that is not yet crimped is formed to have a "U" shape. Crimping of the wire barrel portion 13 is done by pressing the wire barrel portion 13 and the conductor 9 (the strands 7) located within the wire barrel portion 13 by use of the crimper 27*a* and an anvil (not shown in the drawings).

Figure 9:
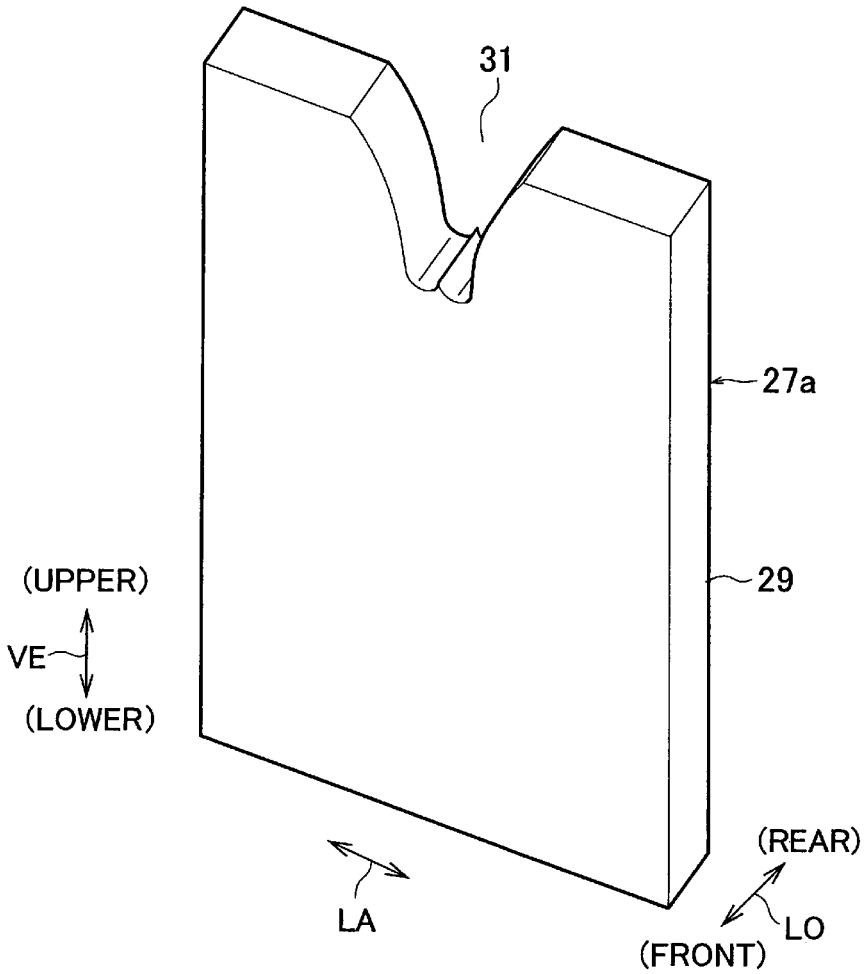
FIG. 9 is a perspective view of a terminal crimper used for crimping the wire terminal.

The crimper 27*a* includes a crimper body 29 formed to have a rectangular flat-planar shape. A notch 31 is formed on the crimper body 29. When crimping the wire barrel portion 13, the wire barrel portion 13 in which the conductor 9 is being set and the anvil enter into the notch 31 sequentially in this order. A first curved surface (first curved portion) 33 and a second curved surface (second curved portion) 35 are formed on the bottom of the notch 31 as shown in FIG. 9 [the curved surfaces 33 and 35 are formed at an uppermost portion in the notch 31 in the vertical direction VE (see FIGS. 10A and 10C)].

The first curved surface 33 contacts with the first side plate 17, and then curls the first side plate 17 together with the anvil to hold the conductor 9 tightly between the first side plate 17 and part of the bottom plate 15, i.e. swages the first side plate 17. Similarly, the second curved surface 35 contacts with the second side plate 19, and then curls the second side plate 19 together with the anvil to hold the conductor 9 tightly between the second side plate 19 and remaining part of the bottom plate 15, i.e. swages the second side plate 19.

The first curved surface 33 and the second curved surface 35 are adjacent to each other. The border ridge 37 between the first curved surface 33 and the second curved surface 35 extends in the longitudinal direction LO (the longitudinal direction of the electric wire 3 when crimping the wire barrel portion 13). Namely, the border ridge 37 doesn't incline with respect to the longitudinal direction LO.

Figure 12D:
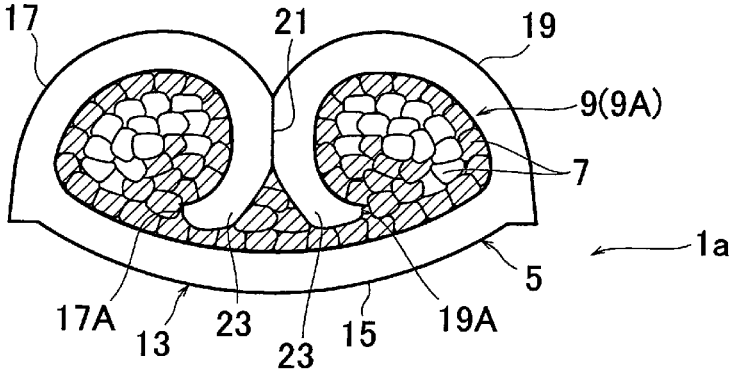
FIG. 12D is a cross-sectional view showing all strands directly contacting with a wire barrel portion by hatchings.

According to the terminated wire 1*a*, as shown in FIGS. 12A to 12C, the extending length of the first side plate 17 from the side-plate contacting portion 21 (the extending length of the end portion 23) gradually decreases from front to rear, and the extending length of the second side plate 19 from the side-plate contacting portion 21 (the extending length of the end portion 23) gradually increases from front to rear. Therefore, the strands 7 (the conductor 9) can be held by the side plates 17 and 19 in a well-balanced manner without changing a lateral size and a vertical size of the wire barrel portion 13 along the longitudinal direction LO (i.e. while keeping the lateral size and the vertical size of the wire barrel portion 13 constant along the longitudinal direction LO). Note that FIG. 12D shows all the strands 7 contacting directly with the wire terminal 5 (the wire barrel portion 13=the bottom plate 15+the side plates 17 and 19) by hatchings (i.e. superimposition of FIGS. 12A to 12C).

In addition, according to the terminated wire 1*a*, in the state where the wire barrel portion 13 is expanded flat, the side edge 17A of the first side plate 17 extends obliquely with respect to the longitudinal direction (the longitudinal direction of the electric wire 3) and the side edge 19A of the second side plate 19 extends obliquely in parallel to the side edge 17A. Therefore, the strands 7 (the conductor 9) can be held by the side plates 17 and 19 in a well-balanced manner, and the side edges 17A and 19A can be easily entered into the conductor 9 because reactive forces that apply from the conductor 9 to the side edges 17A and 19A during crimping are reduced.

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

For example, the electric wire 3 may include, within the sheath 11, an anti-tension string, a rip cord for ripping the sheath 11 and so on in addition to the strands 7.

Figure 10A:
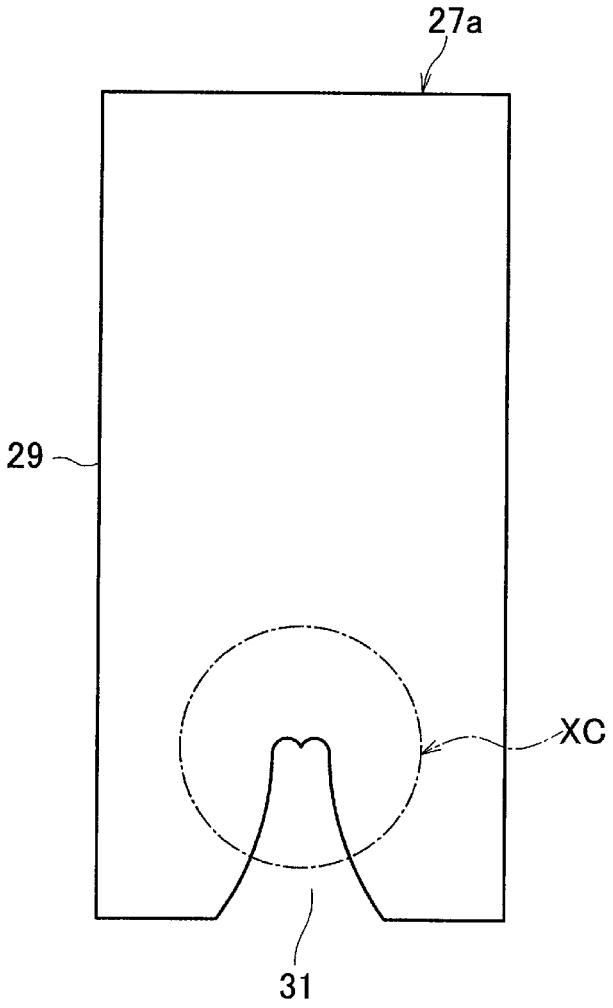
FIG. 10A is a front view of the terminal crimper.
Figure 10C:
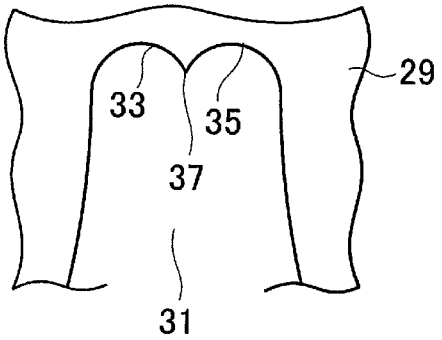
FIG. 10C is an enlarged front view of a portion XC shown in FIG. 10A.
Figure 10B:
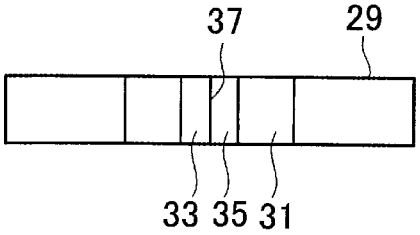
FIG. 10B is a bottom view of the terminal crimper.
Figure 11:
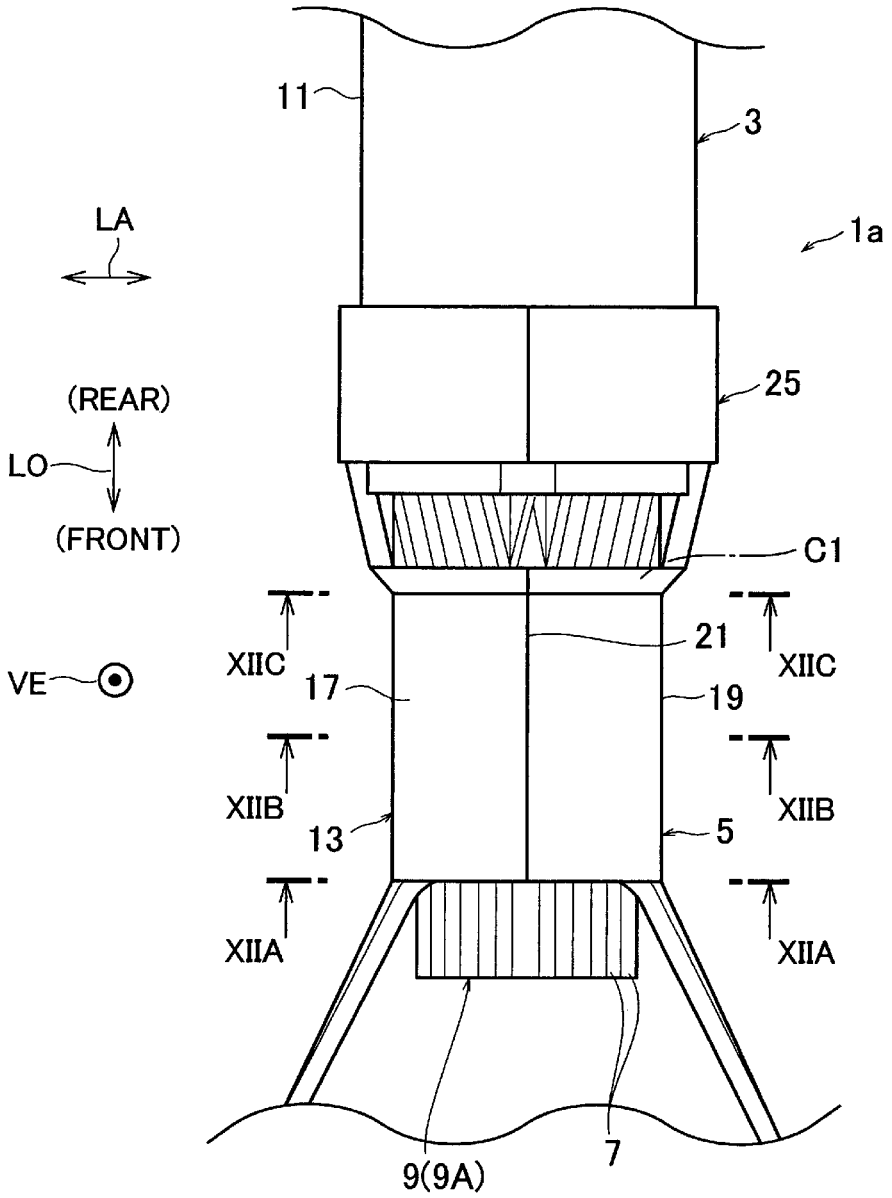
FIG. 11 is a plan view of the terminated wire.

In the first embodiment, the terminated wire 1 is made by crimping the versatile wire terminal 5 with the side edges 17A and 19A extending in the longitudinal direction LO (FIG. 3) by use of the crimper 27 with the border ridge 37 extending obliquely with respect to the longitudinal direction LO (FIGS. 4A to 4D). In the second embodiment, the terminated wire 1*a* is made by crimping the wire terminal 5 with the side edges 17A and 19A extending obliquely with respect to the longitudinal direction LO (FIG. 7) by use of the versatile crimper 27*a* with the border ridge 37 extending in the longitudinal direction LO (FIG. 10A to 10C). However, a terminated wire can be made by crimping the wire terminal 5 with the side edges 17A and 19A extending obliquely with respect to the longitudinal direction LO (FIG. 7) by use of the crimper 27 with the border ridge 37 extending obliquely with respect to the longitudinal direction LO (FIGS. 4A to 4D).

A terminated wire can be made by crimping a wire terminal 5 with its side edge 17A extending obliquely with respect to the longitudinal direction LO but its side edge 19A extending in the longitudinal direction LO by use of the crimper with the border ridge 37 extending in the longitudinal direction LO (27*a*: FIGS. 10A to 10C) or extending obliquely with respect to the longitudinal direction LO (27: FIGS. 4A to 4D).

The above-described terminated wire 1 or 1*a* is also an embodiment of an electric wire terminated with a wire terminal, comprising:

the electric wire including a conductor comprising a plurality of strands and a sheath covering the conductor, a given length of the conductor being exposed from the sheath; and the wire terminal including a wire barrel portion comprising a bottom plate and a pair of side plates extending from both side edges of the bottom plate, respectively, wherein the wire barrel portion holds the conductor exposed from the sheath to make an electrical connection with the strands, the wire barrel portion is asymmetric with respect to a plane including a center axis of the electric wire extending in a longitudinal direction of the electric wire and a center of the bottom plate to increase the number of the strands contacting directly with the wire barrel portion.

The above-described terminated wire 1 or 1*a* is also an embodiment of an electric wire terminated with a wire terminal, comprising:

the electric wire including a conductor comprising a plurality of strands and a sheath covering the conductor, a given length of the conductor being exposed from the sheath; and the wire terminal including a wire barrel portion comprising a bottom plate and a pair of side plates extending from both side edges of the bottom plate, respectively, wherein the wire barrel portion holds the conductor exposed from the sheath to make an electrical connection with the strands, cross-sectional shapes of the side plates on cross-sectional planes perpendicular to a longitudinal direction of the electric wire are shifted along the longitudinal direction of the electric wire to increase the number of the strands contacting directly with the wire barrel portion.

What is claimed is:

1. An electric wire terminated with a wire terminal, comprising:

the electric wire including a conductor comprising a plurality of strands and a sheath covering the conductor, a given length of the conductor being exposed from the sheath; and the wire terminal including a wire barrel portion comprising a bottom plate, a first side plate extending from one side edge of the bottom plate and a second side plate extending from another side edge of the bottom plate, the one side and the other side of the bottom plate being opposite to each other, wherein the wire barrel portion holds the conductor exposed from the sheath to make an electrical connection with the strands, the number of the strands contacting directly with the first side plate gradually changes along a longitudinal direction of the conductor exposed from the sheath, the number of the strands contacting directly with the second side plate gradually changes along the longitudinal direction of the conductor exposed from the sheath inversely with respect to the first side plate, and an end portion of the first side plate, on a side of the first side plate opposite from the bottom plate, and end portion of the second side plate, on a side of the second plate opposite from the bottom plate, extend towards the bottom plate in at least one same cross-sectional view of the wire barrel portion perpendicular to the longitudinal direction.

2. The electric wire terminated with the wire terminal according to claim 1, wherein, when a direction perpendicular to the longitudinal direction and extending from the one side of the bottom plate toward the other side of the bottom plate is denoted as a lateral direction, on cross-sectional views of the barrel portions perpendicular to the longitudinal direction, each of the first side plate and the second side plate forms an arc to surround the strands, a chord length of the arc of the first side plate in the lateral direction gradually decreases from one side to another side of the wire barrel portion along the longitudinal direction, and a chord length of the arc of the second side plate in the lateral direction gradually increases from the one side to the other side of the wire barrel portion along the longitudinal direction.

3. The electric wire terminated with the wire terminal according to claim 1, wherein, when a direction perpendicular to the longitudinal direction and extending from the one side of the bottom plate toward the other side of the bottom plate is denoted as a lateral direction, on cross-sectional views of the barrel portions perpendicular to the longitudinal direction, each of the first side plate and the second side plate forms an arc to surround the strands, the first side plate and the second side plate contact with each other at an intermediate position in each extending direction thereof to form a side-plate contacting portion, an extending length of the first side plate from the side-plate contacting portion gradually decreases from one side to another side of the wire barrel portion along the longitudinal direction, and an extending length of the second side plate from the side-plate contacting portion gradually increases from the one side to the other side of the wire barrel portion along the longitudinal direction.

4. The electric wire terminated with the wire terminal according to claim 1, wherein, in a state where the wire terminal were expanded flat, a side edge of the first side plate extends obliquely with respect to the longitudinal direction, and a side edge of the second side plate extends obliquely with respect to the longitudinal direction to be parallel to the side edge of the first side plate.

5. A wire terminal comprising:

a wire barrel portion including a bottom plate, a first side plate extending from one side edge of the bottom plate, and a second side plate extending from another side edge of the bottom plate, the one side and the other side of the bottom plate being opposite to each other, wherein, in a state where the wire terminal were expanded flat, a side edge of the first side plate extends obliquely with respect to the longitudinal direction from a first end to a second end of the side edge of the first side plate, and a side edge of the second side plate extends obliquely with respect to the longitudinal direction from a first end to a second end of the side edge of the second side plate to be parallel to the side edge of the first side plate.

6. A wire terminal crimper to be used with an anvil when crimping a wire barrel portion of a wire terminal such that the wire barrel portion holds an conductor of an electric wire, the wire terminal including a wire barrel portion comprising a bottom plate and a first side plates extending from one side edge of the bottom plate and a second side plates extending from another side edge of the bottom plate and the conductor being exposed by a given length, the crimper comprising:

a crimper body; and a notch formed in the crimper body and to which the wire barrel portion and a plurality of strands of the conductor are to be entered when crimping the wire barrel portion, wherein a first curved portion to be contacted with the first side plate of the wire terminal to crimp the first side plate and a second curved portion to be contacted with the second side plate of the wire terminal to crimp the second side plate are formed on the bottom of the notch, the notch being open to an outside of the crimper body in a first direction that is perpendicular to a longitudinal direction of the conductor when crimping the wire terminal, the first curved portion and the second curved portion are adjacent to each other, and a border ridge between the first curved portion and the second curved portion extends obliquely with respect to the longitudinal direction of the conductor when crimping the wire terminal, wherein the border ridge is located, in a cross-sectional view of the wire terminal crimper that is perpendicular to the longitudinal direction of the conductor when crimping the wire terminal, in the first direction from a position of the first curved portion and a position of the second curved portion that are furthest in a second direction that is opposite of the first direction.

* * * * *